US006506509B1

(12) United States Patent
Feldstein et al.

(10) Patent No.: US 6,506,509 B1
(45) Date of Patent: Jan. 14, 2003

(54) SELECTIVE CODEPOSITION OF PARTICULATE MATTER AND PLATED ARTICLES THEREOF

(75) Inventors: Michael David Feldstein, Belle Mead, NJ (US); Thomas Stephen Lancsek, Trenton, NJ (US)

(73) Assignee: Surface Technology, Inc., Trenton, NJ (US)

( * ) Notice: Subject to any disclaimer, the term of this patent is extended or adjusted under 35 U.S.C. 154(b) by 0 days.

(21) Appl. No.: 09/369,141

(22) Filed: Aug. 5, 1999

(51) Int. Cl.[7] ..... B32B 19/00

(52) U.S. Cl. ..... 428/702; 428/610; 428/621; 428/627; 428/632; 428/328; 428/402; 428/469; 428/472; 428/701; 427/241; 427/437; 427/438; 427/443.1; 205/109; 205/143

(58) Field of Search ..... 427/241, 437, 427/438, 443.1; 205/109, 143; 428/328, 469, 402, 472, 547, 610, 472.2, 698, 621, 699, 627, 701, 632, 702, 634, 936

(56) References Cited

U.S. PATENT DOCUMENTS 4,305,792 A * 12/1981 Kedward et al.
5,702,763 A * 12/1997 Feldstein
5,707,725 A * 1/1998 Feldstein et al.

* cited by examiner

*Primary Examiner*—Deborah Jones
*Assistant Examiner*—Wendy Boss

(57) ABSTRACT

The present invention relates to composite electroless coatings with varying densities of codeposited particles in the plated layer along the surface of the substrate where said variation of densities is directed by the angle of rotation of the substrate during the coating process.

22 Claims, 2 Drawing Sheets

SELECTIVE CODEPOSITION OF PARTICULATE MATTER AND PLATED ARTICLES THEREOF

BACKGROUND OF THE INVENTION

This invention relates to the distribution of particles within composite plating.

Composite plating is a technology well documented and widely practiced in both electrolytic and electroless plating. Composite plating refers to the inclusion of particulate matter within a plated layer as illustrated in FIG. 1. The development and acceptance of composite plating stems from the discovery that the inclusion of particles within a plated layer can enhance various properties of the plated layer, and in many situations actually provide entirely new properties to the plated layer. Particles of various materials can provide characteristics including wear resistance, lubricity, corrosion resistance, phosphorescence, friction, altered appearance, and others.

Although composite electrolytic plating predates composite electroless plating, composite electroless plating has been developed into a well established field. A well documented survey of composite electroless plating can be found in "Electroless Plating Fundamentals and Applications" edited by G. Mallory and J. B. Hadju, Chapter 11, published by the American Electroplaters Society, 1990, incorporated herein by reference.

Early development of composite electroless plating includes the work of Odekeren in U.S. Pat. No. 3,644,183 which was directed toward increasing the corrosion resistance by the incorporation of certain particulate material. Metzger et al documented a wider variety of plated alloys and particulate materials capable of being composite plated in U.S. Pat. No. 3,753,667. In U.S. Pat. Nos. 3,562,000 and 3,723,078, Parker further demonstrated an assortment of materials including metallic particles which can be codeposited from an electroless plating bath. This early work was all directed at producing composite plated layers with a uniform dispersion of particulate matter within the metal matrix.

In U.S. Pat. No. 3,853,094, incorporated herein by reference, Christini et al disclosed an electroless plating apparatus which serves to insure the uniformity of particulate dispersion within a composite electroless plated layer. Subsequent work by Christini et al in U.S. Pat. Nos. 3,936,577 and 3,940,512, and Reissue U.S. Pat. Nos. 29,285 and 33,767 concentrated on the codeposition of diamond particles within electroless plating. These patents were similarly concerned with the uniform dispersion of particles within the plated layer.

Additional inventions in the field of composite electroless plating include the use of a wider array of particulate materials such as Yano et al in U.S. Pat. No. 4,666,786 and Henry et al in U.S. Pat. No. 4,830,889.

Feldstein taught the utility of an overlayer above the composite plated layer for smoothness advantages in U.S. Pat. Nos. 4,358,922 and 4,358,923, incorporated herein by reference.

Spencer et al illustrated the benefit of including a blend of distinct particle sizes within the composite plated layer.

Feldstein et al disclosed plating bath stability benefits resulting from the addition of particulate matter stabilizers to the plating bath in U.S. Pat. Nos. 4,997,686, 5,145,517, 5,300,330, and 5,863,616 incorporated herein by reference.

In U.S. Pat. No. 4,716,059 Kim demonstrated plating solutions with non-ionic surfactants having specific HLB numbers for composite plating graphite fluoride.

Significant work has been done in the composite plating of parts utilized in the textile industry. Herbert et al's U.S. Pat. No. 4,193,253 relates to the composite plating of rotors with silicon carbide, incorporated herein by reference. Lancsek's U.S. Pat. No. 4,859,494 involves open end spinning combing rolls, incorporated herein by reference.

In all of the above referenced work, the intentions and results were uniformity in particulate dispersion within the plated layer and uniformity of the composite plated layer on all surfaces of the plated articles. In U.S. Pat. No. 5,520,791, incorporated herein by reference, Murase departed from earlier work by demonstrating a non-homogenous composite plated layer for the internal surfaces of a cylinder of an internal combustion engine block wherein the density of particulate matter near the outer surface of the plated layer is greater than that of the inner portion of the coating adjacent to the substrate. In U.S. Pat. No. 5,707,725, incorporated herein by reference, Feldstein et al disclosed methods to produce composite electrolessly plated articles with a gradient in particulate density ranging from a higher density adjacent to the substrate to a lower density at the outer surface of the coating.

All of the previous work, including the Murase U.S. Pat. No. 5,520,791 and Feldstein et al U.S. Pat. No. 5,707,725, share the characteristic that the composite electroless coatings were uniform along the surface of the substrates. In U.S. Pat. Nos. 5,674,631 and 5,702,763, incorporated herein by reference, Feldstein disclosed a method of increased substrate rotation to achieve varying densities of codeposited particulate matter in the plated layer along the surface of the substrate. This invention was termed "selective codeposition" by the inventor. Numerous benefits for this novel method were further presented including particulate savings, cost reductions, and decreased bath loading.

The present invention is a method to provide composite electroless coatings with varying densities of codeposited particles in the plated layer along the surface of the substrate to specified area(s) of the substrate.

SUMMARY OF THE INVENTION

The present invention demonstrates a method of composite electroless plating with varying densities of codeposited particles in the plated layer along the surface of the substrate. This invention is a departure from the prior art in that it discloses a method for directing the varying densities of codeposited particle to specified area(s) of the substrate. In the prior art, the pattern of the varied density of codeposited particles in the plated layer was a function of rotational speed and geometry of the substrate. A suitable rotational speed may be found to provide a variation in density of codeposited particles in the plated layer along the surface of the substrate for articles of certain geometries. However, adjustment of rotation speed alone may not be sufficient to produce a variation in density of codeposited particles in the plated layer along the surface of the substrate for articles of other geometries in a commercially or functionally useful condition.

We have discovered that a modification of the angle of rotational axis during composite electroless plating at high rotational speeds provides the ability to direct the variations of codeposited particles in the plated layer to specific areas along the surface of the substrate. For example; articles of certain geometries are capable of being plated according to the methodology of the prior art to achieve a variation in densities of codeposited particles within the plated layer along the surface of the substrate, but this variation may not be the most desirable pattern of variation desired. Areas of the substrate where high codeposited particle densities are desired may not have the optimal particle density. Conversely, areas of the substrate where a lower particle density or no codeposition of particles is desired may receive a higher codeposition of particles than desired.

One such example can be found with the coating of a rotor cup useful in open end textile spinning. Such rotor cups may be manufactured of steel, aluminum, or boronized steel. On these cup shaped parts, there are only four areas along the substrate where codeposition of particles is necessary as illustrated in FIG. 2: the sliding wall (1), the groove (2), the groove wall (3), and the step (4), inside the cup. Codeposition of particles on the entire outer surface (5) is.unnecessary. No coating is typically applied in the bore (6) in which a shaft is installed to rotate the rotor cup for use. By fixing the angle of the rotor cup's axis of symmetry to a value other than zero, a variation in codeposited particles within the plated layer along the surface of the substrate was achieved whereby the critical internal surfaces achieved a high level of codeposition while the outer surfaces demonstrated essentially no codeposition of particulate matter. In this one example, the present invention has made this process viable for substrates of this geometry and to realize the substantial benefits presented here and in the prior art. While this example relates to a specific article and wear resistant particles, the present invention extends to articles of any geometry and use, and composite electroless coatings consisting of any metal or alloy with particulate matter of any material. The thickness of the coating can be up to 100 microns, preferably within the range of 10 to 50 microns.

DETAILED DESCRIPTION OF THE INVENTION

Codeposition of particulate matter within electroless plating is well documented and widely practiced. Those in the field have developed an extensive array of particles of various sizes and materials which can be codeposited within numerous metals and alloys. Wherein particles of up to 50 microns may be codeposited, with a preferred particle range typically between 0.1 to 10 microns. Since the early development of such composite coatings, the intentions of the practice were always to produce coatings with a uniformity of codeposited particles within the plated layer along the surface of the substrate. Even inventions directed at producing a plated layer with a gradient of particle densities from the inner to outer regions of the coating in relation to the substrate, were uniform along the surface of the substrate. A cross sectional view of the coating at any location along the surface of the substrate, for example, would look essentially the same as any other location along the surface of the same substrate.

The prior art which first demonstrated the ability to produce a coating with a variation in codeposited particles within the plated layer along the surface of the substrate used rotational speed to accomplish this objective for numerous benefits including particle conservation, cost reductions, and decreased plating bath loading with particulate material. This prior art, however, relied only on rotation of the substrate on a single axis which was at zero degrees to the surface of the plating bath. As in the following example, the present invention demonstrates how setting the axis of rotation to an angle other than zero degrees is able to direct the areas of differing codeposited particle densities to various areas along the surface of the substrate.

EXAMPLES

Figure 1:
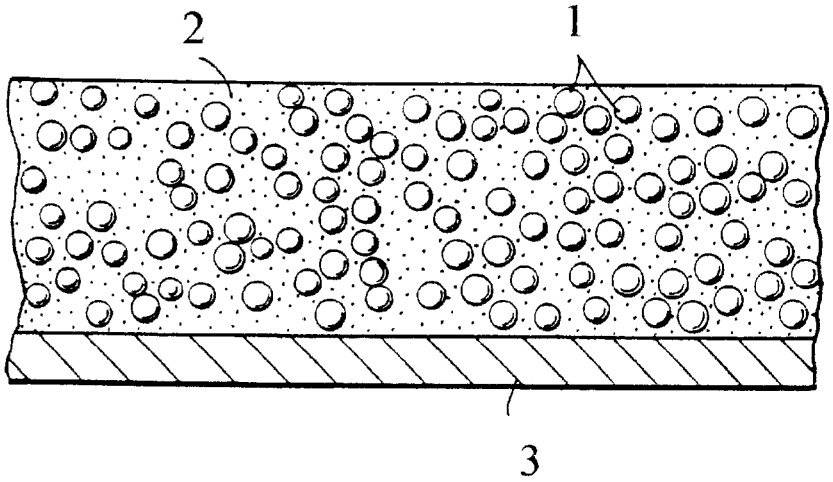
FIG. 1 is a cross sectional view of a composite plated layer on the surface of an article where area 3 is the article, area 2 is the matrix of the plated layer, and area 1 is the codeposited particles in the plated layer.

The following examples are given in order to demonstrate the new and novel issues set forth in the text. For the purposes of this demonstration, particle count per unit area will be used as it was in U.S. Pat. Nos. 5,674,631 and 5,702,763 incorporated herein by reference.

In examples 1–4 of the present invention, diamond particles with a mean diameter of about 1.7 microns were used. They were dispersed into a commercial electroless nickel bath, NiPlate 800, of Surface Technology, Inc. of Trenton, N.J. It is noted that the present invention is not limited to the type of bath or particle used whether it is an electroless or electrolytic type, nor is this invention limited to the type of metal being plated. The diamond dispersed within the bath was at a concentration of 18 grams per liter. The bath was maintained at the operating conditions recommended by the manufacturer. In general, a plating cycle of 2.5 hours was used. At the conclusion of the plating cycle, cross sections of the composite coating were examined microscopically to determine the particle concentration by counting the number of particles within a fixed cross sectional area. In all examples below, rotational speed of the rotors was constant at 150 rpm's. All rotors tested had identical groove geometries. In order for a rotor coating to be useful in extending part life, the composite coating must function well at four specific areas in the rotor. These four areas can be specified as follows, as noted on FIG. 2.

Area 1: the "sliding wall"

Area 2: the "groove wall adjacent to the sliding wall"

Area 3: the "bottom of the groove"

Area 4: the "step" area opposite Area 2 and adjacent to the bottom of the groove.

A significantly reduced particle count in any of these four areas will cause excessive and premature wear of the rotor, rendering it unacceptable for continued use.

Example 1

Rotor Cup A Coated with its Axis of Symmetry at 0°.

Area 1: 47 particles counted

Area 2: 7 particles counted

Area 3: 51 particles counted

Area 4: 43 particles counted

Example 2

Rotor Cup B Coated with its Axis of Symmetry at +10°.

Area 1: 45 particles counted

Area 2: 43 particles counted

Area 3: 47 particles counted

Area 4: 46 particles counted

Example 3

Rotor Cup C Coated with its Axis of Symmetry at +30°.

Area 1: 51 particles counted

Area 2: 47 particles counted

Area 3: 44 particles counted

Area 4: 10 particles counted

Example 4

Rotor Cup D Coated with its Axis of Symmetry at −210°.

Area 1: 37 particles counted

Area 2: Very little to no plating due to heavy particle accumulation in these areas.

Area 3: Very little to no plating due to heavy particle accumulation in these areas.

Area 4: Very little to no plating due to heavy particle accumulation in these areas.

In Examples 5 and 6 of the present invention, silicon carbide particles with a mean diameter of about 2 microns were used. They were dispersed into a commercial electroless nickel bath, NiPlate 700, of Surface Technology, Inc. of Trenton, N.J. It is noted that the present invention is not limited to the type of bath or particle used whether it is an electroless or electrolytic type, nor is this invention limited to the type of metal being plated. The silicon carbide dispersed within the bath was at a concentration of 18 grams per liter. The bath was maintained at the operating conditions recommended by the manufacturer. In general, a plating cycle of 2.5 hours was used. At the conclusion of the plating cycle, cross sections of the composite coating were examined microscopically to determine the silicon carbide concentration by counting the number of particles within a fixed cross sectional area.

Example 5

Rotor Cup E Coated with its Axis of Symmetry at 0°.

Area 1: 20 particles counted

Area 2: 16 particles counted

Area 3: 8 particles counted

Area 4: 2 particles counted

Example 6

Rotor Cup F Coated with its Axis of Symmetry at 20°.

Area 1: 18 particles counted

Area 2: 14 particles counted

Area 3: 21 particles counted

Area 4: 10 particles counted

In Examples 7 and 8 of the present invention, aluminum oxide particles with a mean diameter of about 1–2 microns were used. They were dispersed into a commercial electroless nickel bath, NiPlate 800, of Surface Technology, Inc. of Trenton, N.J. It is noted that the present invention is not limited to the type of bath or particle used whether it is an electroless or electrolytic type, nor is this invention limited to the type of metal being plated. The aluminum oxide dispersed within the bath was at a concentration of 18 grams per liter. The bath was maintained at the operating conditions recommended by the manufacturer. In general, a plating cycle of 2.5 hours was used. At the conclusion of the plating cycle, cross sections of the composite coating were examined microscopically to determine the aluminum oxide concentration by counting the number of particles within a fixed cross sectional area.

Example 7

Rotor Cup G Coated with its Axis of Symmetry at 0°.

Area 1: 3 particles counted

Area 2: 7 particles counted

Area 3: 9 particles counted

Area 4: 1 particles counted

Example 8

Rotor Cup H Coated with its Axis of Symmetry at 20°.

Area 1: 11 particles counted

Area 2: 11 particles counted

Area 3: 14 particles counted

Area 4: 9 particles counted

In examples 9 and 10 of the present invention, silicon carbide particles with a mean diameter of about 2 microns were used. They were dispersed into a commercial electroless nickel bath, NiPlate 700, of Surface Technology, Inc. of Trenton, N.J. It is noted that the present invention is not limited to the type of bath or particle used whether it is an electroless or electrolytic type, nor is this invention limited to the type of metal being plated. The silicon carbide dispersed within the bath was at a concentration of 18 grams per liter. The bath was maintained at the operating conditions recommended by the manufacturer. In general, a plating cycle of 2.5 hours was used. At the conclusion of the plating cycle, cross sections of the composite coating were examined microscopically to determine the silicon carbide concentration by counting the number of particles within a fixed cross sectional area.

Figure 3:
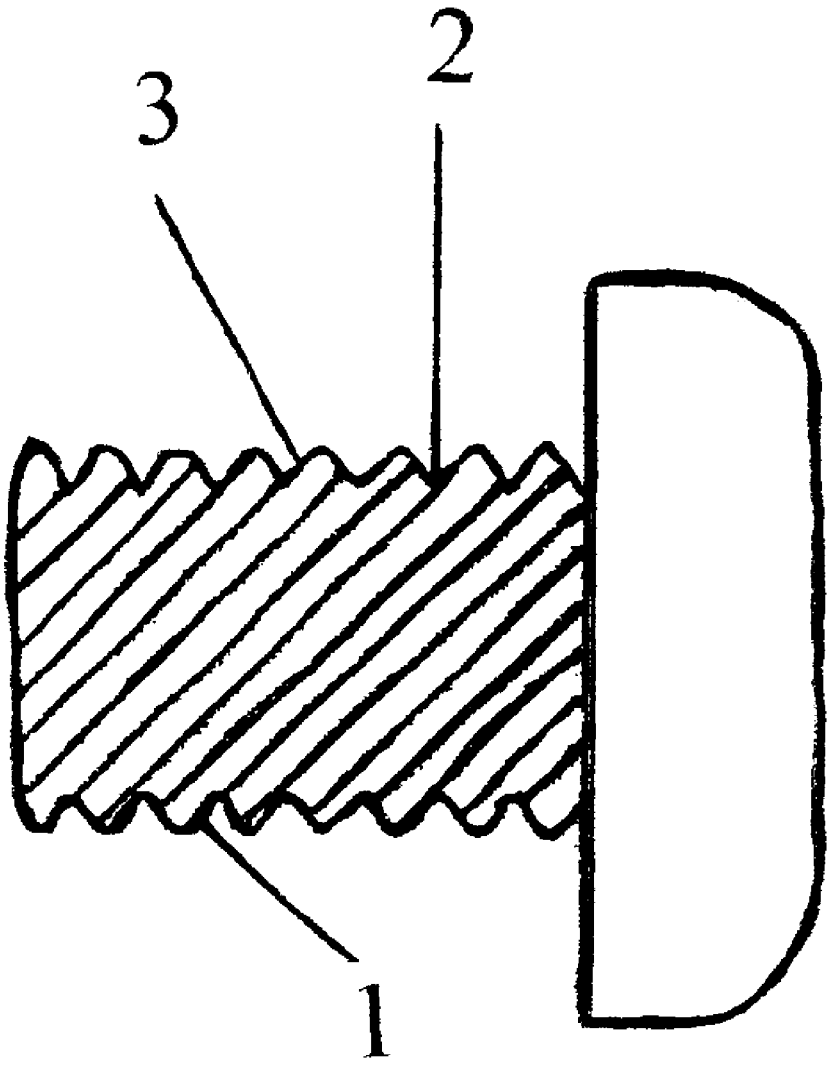
FIG. 3 is a cross sectional view of a threaded screw where area 1 is a descending thread angle, area 2 is a trough or base of a thread, and area 3 is an ascending thread angle.

In examples 9 and 10, steel ⅜" diameter rods with standard ⅜"–16 threads were coated at 150 rpm's with all plating parameters consistent except the angle of the axis of the rotation of the rods. This angle was varied between the two examples to demonstrate the novelty of the present invention in directing the codeposition of particles to different areas of the coating along the surface of the substrate. Three areas of the threaded rod as illustrated in FIG. 3 were analyzed for silicon carbide concentration as follows.

Area 1: the descending thread angle

Area 2: the trough or base of the thread

Area 3: the ascending thread angle

Example 9

Rod A Coated with its Axis of Symmetry at 0°.

Area 1: 1 particle counted

Area 2: 1 particle counted

Area 3: 1 particle counted

Example 10

Rod B Coated with its Axis of Symmetry at 20°.

Area 1: 10 particles counted

Area 2: 12 particles counted

Area 3: 13 particles counted

The meaning of the results in the ten examples above can be summarized as follows.

Rotor cup A in Example 1, coated according to the teachings of the prior art at a zero degree rotational angle, achieved a significant variation in the density of particles codeposited within the plated layer along the surface of the substrate. Areas 1, 3, and 4 achieved high densities of codeposited particles. Area 2 and all other surfaces of the rotor cup achieved little to no codeposition of particles within the plated layer. While the absence of particles on the outer surfaces is a confirmation of the prior art and represents a significant savings in diamond (in this example) particle usage, the significantly lower particle density in area 2 diminishes the commercial functionality of the coated part as area 2 is a high wear area requiring a high density of codeposited particles similar to what was achieved in areas 1, 3, and 4.

In Example 2, the rotational angle of rotor cup B was fixed at 10°. All other plating parameters were identical to Example 1. As the particle count results disclosed above demonstrate, this modification of the rotational angle achieved a significant increase in particle density in area 2 while maintaining similar densities in areas 1, 3, and 4 compared to rotor A in Example 1. All high wear areas of rotor B consequently have ample codeposition of particles due to the adjusted rotational angle.

Example 3, coated with a rotational axis of symmetry at 30°, also demonstrates the improvement achieved by the present invention. In this example, areas 1, 2, and 3 all have sufficiently high densities of codeposited particles to make this article commercially useful. Although the particle count in area 4 of this article is substantially lower than the other three areas, this area has the least wear of all four areas on this type of article. Area 2 of this article has a dramatically increased particle count of 47 in comparison to area 2 of the coated article in Example 1 which had a particle count of only 7.

Example 4, coated at an axis symmetry of −210°, shows that certain angles of rotation are not beneficial towards making certain articles commercially useful, but could be useful for other applications given the dramatic and unanticipated result that the accumulation of particles in areas 2, 3, and 4 during the plating process was so great that it effectively inhibited all plating in those areas.

The results of Examples 5, 6, 7, and 8 demonstrate that this invention is not limited to any specific type nor size of particle.

The results of Examples 9 and 10 show that the utility of this invention extends to other articles and geometries.

DETAILED DESCRIPTION OF THE DRAWINGS

FIG. 1 depicts an enlarged cross sectional view of a typical composite layer of particles (1), in a metal matrix (2), on a body (3).

Figure 2:
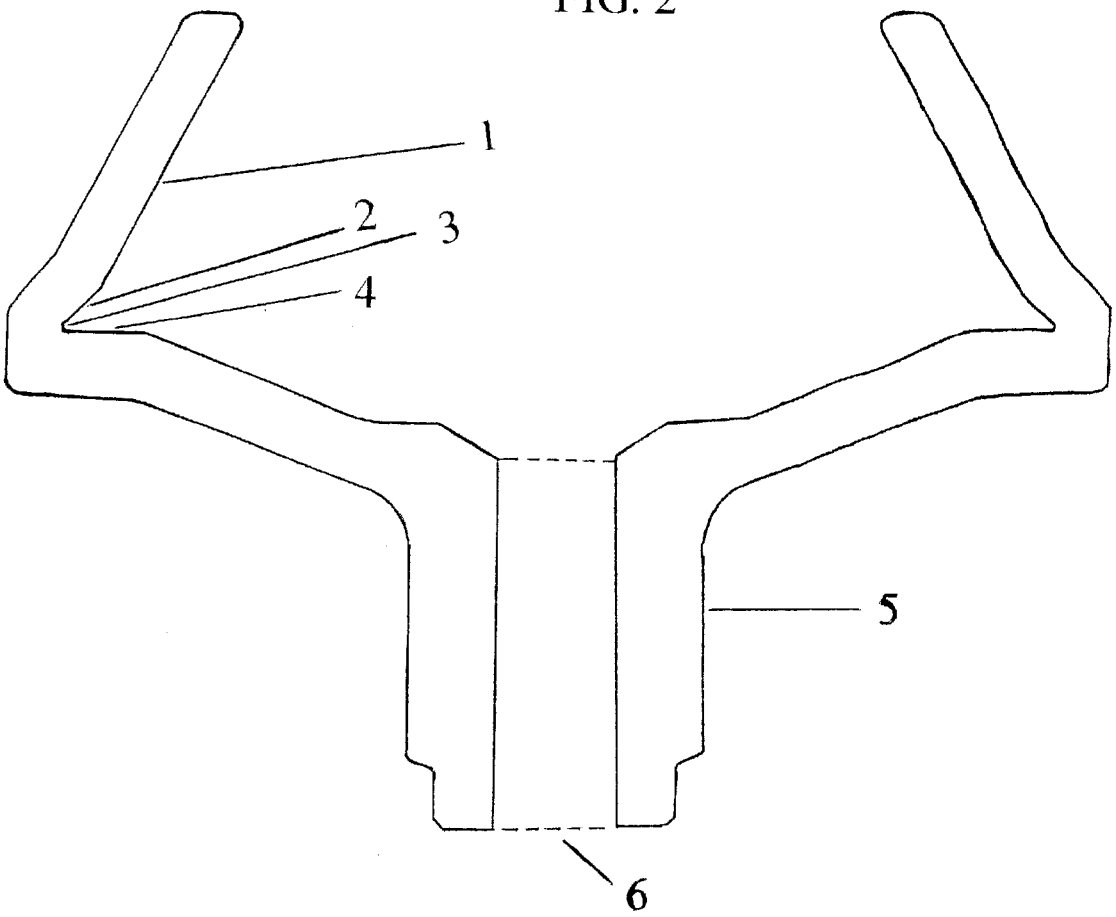
FIG. 2 is a cross sectional view of a rotor cup where area 1 is the sliding wall, area 2 is the groove wall, area 3 is the groove bottom, area 4 is the step surface, area 5 is the outer surface, and area 6 is the bore which is the rotational axis of the rotor cup.

FIG. 2 represents a cross sectional view of a typical rotor cup used in open end textile spinning. Although such rotor cups come in a variety of sizes and geometric variations, the critical wear areas are identified as the sliding wall (1), the groove (2), the groove wall (3), and the step (4). Also identified are the outer surface (5), and the bore (6), on which a shaft is installed to rotate the rotor cup.

FIG. 3 illustrates a typical threaded rod geometry with a descending thread angle (1), a trough or base of the thread (2), and an ascending thread angle (3).

What we claim is:

1. A rotor cup useful for textile manufacturing wherein said rotor cup has a sliding wall, groove wall, groove bottom, step, and outer surfaces having a composite plated layer with a comparatively high density of codeposited particles in the plated layer on the sliding wall, groove wall, groove bottom, and step, and a comparatively low density of codeposited particles in the plated layer on the outer surfaces.

2. The rotor cup as in claim 1 where said plated layer is composite electroless nickel.

3. The rotor cup as in claim 1 where said particles include diamond.

4. The rotor cup as in claim 1 where said particles include silicon carbide.

5. The rotor cup as in claim 1 where said particles include aluminum oxide.

6. The rotor cup as in claim 1 where said particles are up to 50 microns in size.

7. The rotor cup as in claim 1 where said particles are 0.1 to 10 microns in size.

8. The rotor cup as in claim 1 where said rotor cup is steel.

9. The rotor cup as in claim 1 where said rotor cup is boronized steel.

10. The rotor cup as in claim 1 where said plated layer is up to 100 microns.

11. The rotor cup as in claim 1 where said plated layer is 10 to 50 microns.

12. The rotor cup as in claim 1 where said rotor cup is aluminum.

13. The process of providing a rotor cup wherein said rotor cup has a sliding wall, groove wall groove bottom, step, and outer surfaces with a composite plated layer with a variation in density of codeposited particles within the plated layer, said process comprising plating said rotor cup in a composite plating bath where said rotor cup's rotational axis is at an angle other than 0° and where said rotor cup's rotational speed is sufficient to produce a variation in density of codeposited particles within the plated layer with a comparatively high density of codeposited particles in the plated layer on the sliding wall, groove wall, groove bottom, and step, and a comparatively low density of codeposited particles in the plated layer on the outer surfaces.

14. The process as in claim 13 where said plating bath is composite electroless nickel.

15. The process as in claim 13 where said particles includes diamond.

16. The process as in claim 13 where said particles includes silicon carbide.

17. The process as in claim 13 where said particles include aluminum oxide.

18. The process as in claim 13 where said particles are up to 100 microns.

19. The process as in claim 13 where said particles are 0.1 to 10 microns.

20. The process as in claim 13 where said layer is up to 100 microns.

21. The process as in claim 13 where said layer is 10–50 microns.

22. The process as in claim 13 where said rotor cup is steel.

* * * * *